US006631805B2

(12) United States Patent
Bramen

(10) Patent No.: US 6,631,805 B2
(45) Date of Patent: Oct. 14, 2003

(54) MEDICAL PILL DISPENSER

(76) Inventor: Janice B. Bramen, 12325 Horton, Shawnee Mission, KS (US) 66209

( * ) Notice: Subject to any disclaimer, the term of this patent is extended or adjusted under 35 U.S.C. 154(b) by 194 days.

(21) Appl. No.: 09/939,894

(22) Filed: Aug. 27, 2001

(65) Prior Publication Data

US 2003/0038053 A1 Feb. 27, 2003

(51) Int. Cl.[7] ..... B65D 83/04; B65D 1/24
(52) U.S. Cl. ..... 206/538; 220/324
(58) Field of Search ..... 220/324, 326; 206/528, 536, 538, 807; 215/216, 237

(56) References Cited

U.S. PATENT DOCUMENTS

| | | | | |
|---|---|---|---|---|
| 4,062,445 | A | | 12/1977 | Moe |
| 4,069,942 | A | | 1/1978 | Marshall et al. |
| 4,126,247 | A | | 11/1978 | Majka |
| 4,809,874 | A | | 3/1989 | Pehr |
| 4,817,819 | A | | 4/1989 | Kelly |
| 4,925,041 | A | | 5/1990 | Pehr |
| 5,082,114 | A | | 1/1992 | Bunin |
| 5,082,137 | A | | 1/1992 | Weinstein |
| 5,137,260 | A | | 8/1992 | Pehr |
| 5,163,559 | A | | 11/1992 | Bunin |
| 5,207,657 | A | * | 5/1993 | Gibilisco ..... 604/295 |
| 5,240,113 | A | | 8/1993 | Gibilisco |
| 5,275,291 | A | | 1/1994 | Sledge |
| 5,383,559 | A | | 1/1995 | Toren |
| 5,718,347 | A | | 2/1998 | Walker et al. |
| 5,735,406 | A | * | 4/1998 | Keffeler ..... 206/535 |
| 5,758,774 | A | | 6/1998 | Leblong |
| 5,762,199 | A | | 6/1998 | Aguilera |
| 5,775,536 | A | | 7/1998 | Lambelet, Jr. et al. |
| 5,819,968 | A | | 10/1998 | Jones |
| 5,915,558 | A | | 6/1999 | Girvetz |
| 5,915,560 | A | | 6/1999 | George et al. |
| 6,000,546 | A | | 12/1999 | Noble |

* cited by examiner

*Primary Examiner*—Jacob K. Ackun
(74) *Attorney, Agent, or Firm*—John G. McMahon

(57) ABSTRACT

A pill dispenser having a tray body with multiple side by side compartments and a lid hinged to the body. The lid in a closed position is secured to the body by a latch mechanism. The latch mechanism includes a tongue having multiple shoulders. A first of the shoulders engages a bar attached to the lid so as to hold the lid in a closed position. The lid can be released and opened only by physical flexing of the tongue each time the bar engages the pair of shoulders, making the device child resistant. The tongue is also pivotal and can be moved to a non-locking configuration for use by the infirm where children are not present. The dispenser lid spans over and prevents access to multiple pill receiving compartments when in the closed configuration thereof.

6 Claims, 2 Drawing Sheets

MEDICAL PILL DISPENSER

BACKGROUND OF THE INVENTION

The present application is directed to a pill dispenser and, in particular, to such a dispenser having multiple pill receiving chambers that are covered by a single lid when not in use and which are protected by a child resistant latch.

Many persons are required for medical reasons to take one or more prescription or over the counter medication pills at multiple times during a day and/or for multiple days during a week. It is difficult for persons to remember when such pills should be taken and persons with failing memory are even more taxed to remember what should be taken and when, as compared to the population in general.

Consequently, pill dispensers having trays or the like with multiple cavities or chambers have been developed for use by takers of multiple pills. The cavities can be filled and labeled by date or time so the person using the device can readily determine when something should be taken and what has already been taken.

Almost any medicine is a potential hazard to a child for whom the medicine is not intended. Children, especially very young children, will put almost anything in their mouths, including pills. Children often try to open containers and can be poisoned, overdosed or otherwise harmed by taking pills that are not intended for them.

Therefore, it is important to protect pill dispensers from access by children. Various child resistant devices have been provided in the past to secure screw-on lids to bottles of pills, as well as various types of child resistant closures for other types of pill holding devices. It is found that it is desirable to improve on the type of child resistant latches previously available and/or to offer alternative devices.

While child resistant devices can be effective in preventing access by children, they can sometimes be over effective and prevent access to the person for whom the pills are intended. In particular, many persons that require pills are infirm or lack coordination for one reason or another, such that they are unable to open a pill dispenser with complicated or hard to operate child resistant closures. For example, persons with arthritis may have trouble opening some closures.

In some instances such as where the person taking the pills lives alone or at least without any children, it may be desirable to have a pill dispenser that can easily be converted from being child resistant to being easy to open so that the infirm or the like can have access. Consequently, there is need for a pill dispenser having multiple pill holding chambers that are covered by a lid that can alternatively be locked in a closed position that is highly child resistant or easy to open for the infirm and relatively easy to convert between such configurations.

SUMMARY OF THE INVENTION

A pill dispenser is provided that includes a tray with a plurality of compartments, including chambers, cavities or the like, that are sized and shaped to receive pills. Preferably, the compartments are arranged in side by side relationship and may be arranged in a single column or arranged in a matrix of rows and columns. Preferably, each of the compartments includes an independent hinged lid that can be moved to open or close each compartment independently. The compartment lids preferably are also labeled to indicate a day or hour at which time the contents should be taken.

The dispenser also includes a lid that is connected to the tray at one side by a hinge and is selectively joined to the tray on an opposite side by a latch mechanism. The dispenser lid is preferably sized and shaped to cover at least part of the compartment lids when the closure lid is in a closed configuration thereof in such a way as to secured the compartment lids closed, when the dispenser lid is in the closed configuration. It is foreseen that the dispenser lid may be subdivided into multiple units each of which have a hinge and latch mechanism and which secure different groups of compartment lids.

The dispenser lid hinge is designed such that the dispenser lid cannot be disengaged at the hinge from the tray, when the dispenser lid is closed. Preferably, the hinge allows easy attachment or removal of the dispenser lid relative to the tray when the dispenser lid is in an open configuration thereof.

The latch mechanism includes first and second parts or portions which are respectively fixedly attached to the tray and dispenser lid respectively. It is foreseen that the latch mechanism portions can be interchanged.

The first latch portion includes an elongate tongue that is hingedly attached at a lower end to a first of the tray or dispenser lid. The tongue includes a first shoulder in spaced relation from where the tongue is hinged. Further, the tongue includes a second shoulder spaced yet further from the tongue hinge as compared to the first shoulder. The tongue has a first locking configuration and a second non-locking configuration.

Attached to the second of the tray and the dispenser lid is a second part or portion that includes a latching bar. The bar is sized, shaped and positioned to be engaged and captured by the tongue first shoulder and thereby secure the dispenser lid in a closed configuration when the latch is in the locking configuration thereof and the dispensing lid is in a closed configuration thereof.

An upper end of the tongue spaced from the tongue hinge is engagable by a finger of a user to allow a user to push against and depress or modify the shape of the tongue so the first shoulder disengages from the bar. This releases the bar and allows the dispenser lid to partially open; however, before the dispenser lid can be opened completely, the bar engages the tongue second shoulder. In order to fully open the dispenser lid the tongue must again be depressed to disengage the bar from the second shoulder so the dispenser lid can be completely opened. Therefore, the tongue must be independently depressed or otherwise modified twice in order to allow the dispenser lid to be fully opened, thereby making the dispenser lid child resistant, when the latch tongue is in the locking configuration. The dispenser lid and tray also include gripping regions or ears to allow an adult to grip and open the device.

OBJECTS AND ADVANTAGES OF THE INVENTION

Therefore, the objects of the present invention are: to provide a pill dispenser having a plurality of compartments that are covered at least in part by a common closure lid that is secured in a closed configuration by a latch mechanism that is interchangeable between a child resistant configuration and an easy open configuration for use by the infirm; to provide such a dispenser having such a latch that has a tongue that is hinged and can be moved between a locking position and a non-locking position; to provide such a dispenser having such a latch mechanism wherein the tongue has a pair of spaced shoulders that are sized and shaped to sequentially engage and hold a bar when the tongue is in the locking position thereof such that the tongue must be depressed or otherwise manipulated at least twice in order to fully open the dispenser lid and gain access to pills in the dispenser; and to provide such a dispenser that is easy to use, comparatively inexpensive to produce and especially suited for the intended usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

Figure 1:
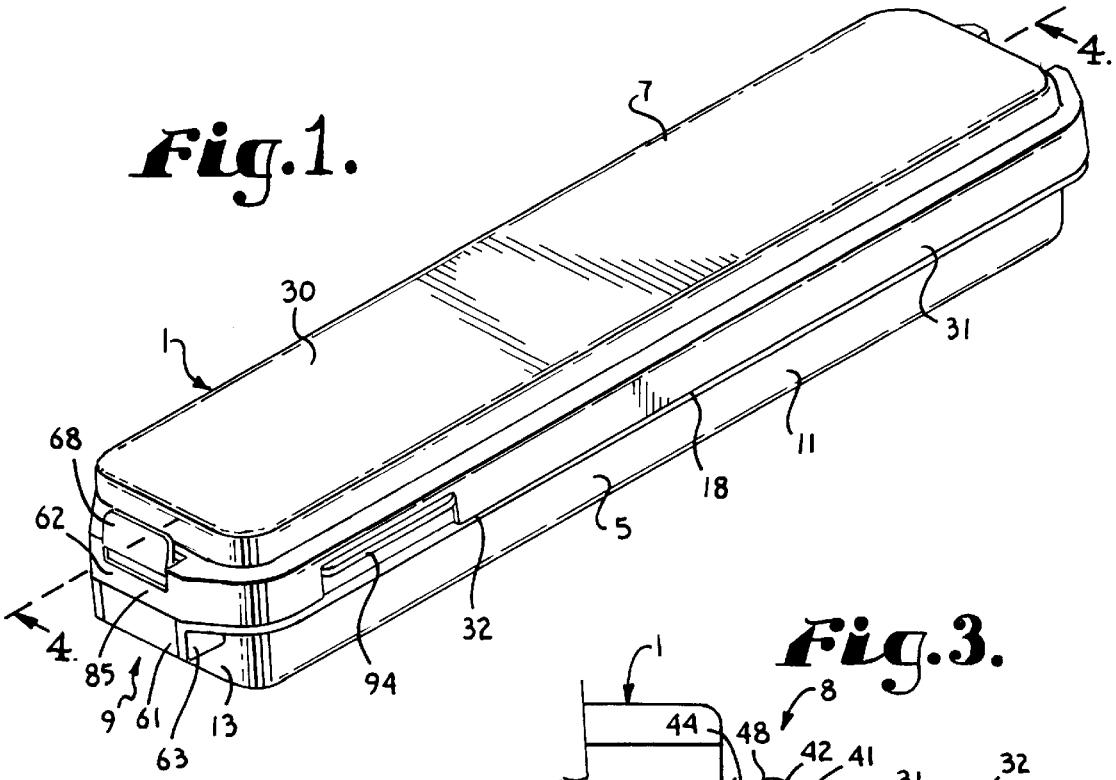
FIG. 1 is a perspective view of a pill dispenser in accordance with the present invention having a convertible latch in a locking position with the lid in a closed and child resistant configuration.
Figure 3:
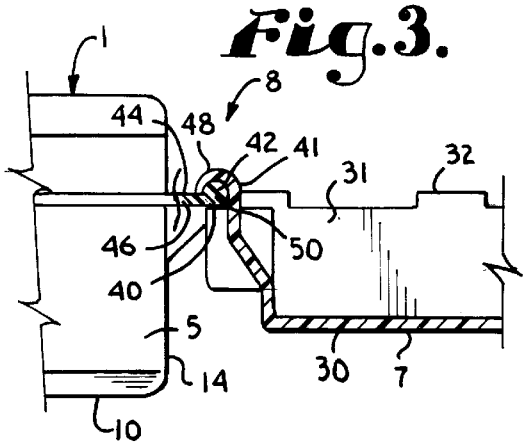
FIG. 3 is an enlarged and fragmentary side elevational view of the dispenser with the lid in the open configuration and with portions broken away to show detail thereof.
Figure 2:
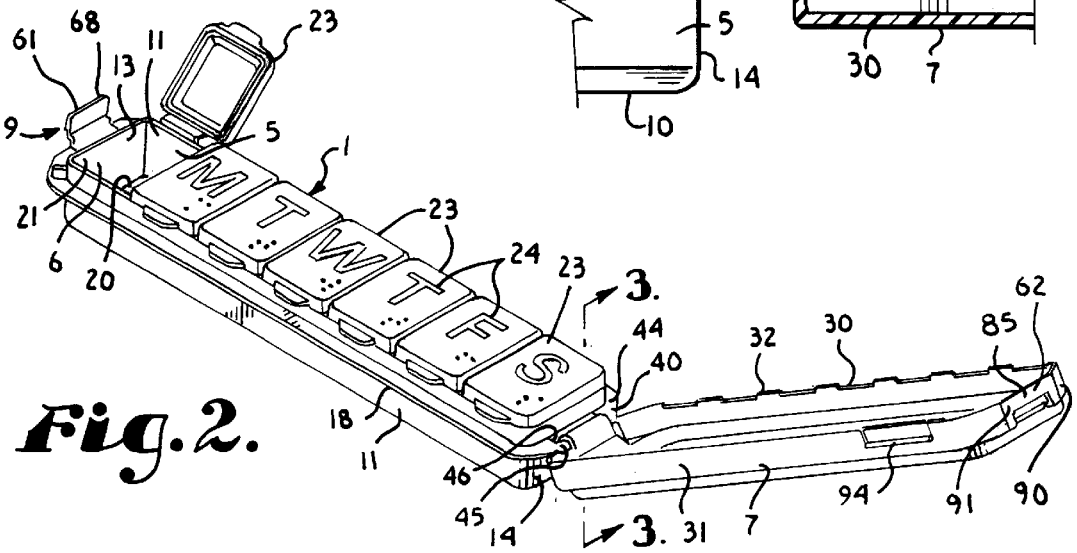
FIG. 2 is a perspective view on a reduced scale of the pill dispenser with the lid in an open configuration.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

with respect to the drawings, the reference numeral 1 generally represents a pill dispenser in accordance with the present invention. The pill dispenser 1 includes a body or tray 5 having a plurality of pill receiving cavities or compartments 6 and a dispenser closure lid 7 having a hinge 8 and a latch mechanism 9.

The illustrated tray 5 is elongate and has seven pill receiving cavities 6 in side by side relationship to each other. The tray 5 has a bottom 10, a pair of parallel side walls 11 and 12 and a pair of end walls 13 and 14. A strengthening and lid supporting ring 18 encircles the tray 5 about halfway between top and bottom thereof except in the region of the latch mechanism 9 and hinge 8.

Each of the pill receiving cavities 6 has a floor 20 and an encircling side wall 21. Each of the compartments 6 also has an independent closure lid 23 with date and/or time indicia 24 that is hinged to part of the tray wall 11. Each closure lid 23, when in a closed configuration, forms a completely enclosed chamber in conjunction with a respective cavity 6. However, it is foreseen that in certain circumstances, the dispenser closure lid 7 may alternatively be used to close the top of the compartments 6, rather than having the independent closure lids 23 for that purpose.

The illustrated dispenser lid 7 is elongate and is sized and shaped to cover the top of the tray 5. However, it is foreseen, where individual closure lids 23 are used, that the dispenser lid 7 need not cover the entire tray 5 or alternatively may be divided into two or more closure lid sections that may have separate hinges and latch mechanisms. Also it is foreseen that a dispenser lid may have multiple hinges and/or multiple latch mechanisms.

The dispenser lid 7 has a top panel 30 with a surrounding peripheral skirt 31 having a bottom edge 32 that engages and rest on the ring 18 when the dispenser lid 7 is closed. The lid top panel 30 is preferably sized, shaped and designed to engage and bias against the closure lids 23 so as to maintain the latter in a closed position, when the dispenser lid is in the closed configuration thereof.

The illustrated hinge 8 has a first section 40 attached to the tray 5 and a second section 41 attached to the dispenser lid 7. The first section 40 includes a circular bar 42 secured at opposite ends to a pair of struts 44 and 45, so as to form an opening 46 therebetween. The second section 41 comprises a semi-circular or half sleeve 48 secured at one end thereof to the dispenser lid 7. An internal surface 50 of the sleeve 48 is sized and shaped to be slidably received on the bar 40 when the sleeve 48 is passed through the opening 46. The sleeve 48 is so positioned such that when the dispenser lid 7 is fully open, the sleeve 48 can be removed from the bar 42 and such that the sleeve 48 cannot be removed from the bar 42 when the dispenser lid 7 is closed. It is foreseen that the first section 40 and second section 41 can be alternatively placed on the opposite members as compared to those described and that other types of hinges or connecting devices could be used with the lid.

The latch mechanism 9 includes a first portion 60 and a second portion 61 with the first portion 60 being located on either the tray 5 or the dispenser lid 7 with the other portion 61 being located on the opposite of the tray 5 or lid 7.

The latch mechanism first portion 60 includes a support structure 63 secured to the tray 5. Located within the support structure 63 is a pair of parallel walls 64 that are sized and positioned to function as a fulcrum for a latch or tongue 68, as will be described later. It is foreseen that the walls 64 could be replaced by a single wall or the like that provide a similar function of backing the latch and allowing the latch to be bent backwards over same.

Figure 5:
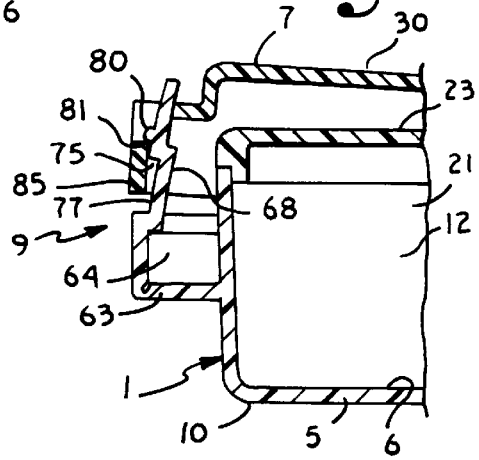
FIG. 5 is an enlarged and fragmentary cross sectional view of the dispenser, similar to FIG. 4, except the lid is in a first stage of opening.
Figure 6:
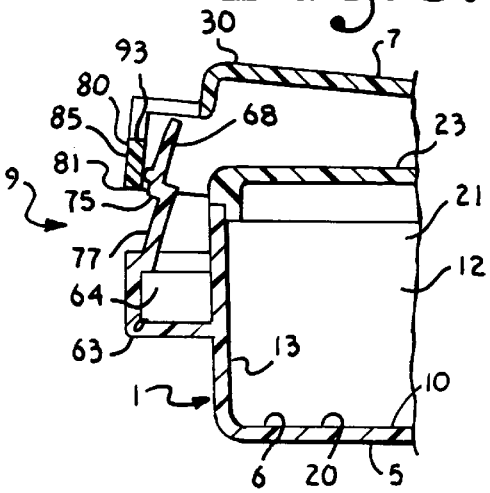
FIG. 6 is an enlarged and fragmentary cross sectional view of the dispenser, similar to FIG. 4, except that the lid is in a second stage of being opened and is now in the open configuration thereof.
Figure 7:
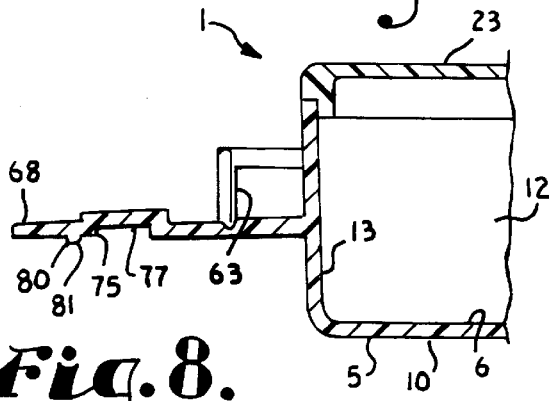
FIG. 7 is an enlarged and fragmentary cross sectional view of the dispenser similar to FIG. 4, except that the latch is in an easy open configuration thereof.
Figure 8:
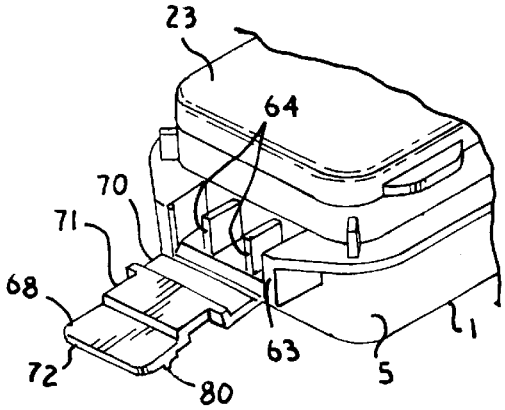
FIG. 8 is an enlarged and fragmentary perspective view of the dispenser with the lid in the closed configuration thereof and with the latch in the easy open configuration thereof.

Pivotally attached to the outermost lower edge of the support structure 63 is the tongue 68. The tongue 68 is elongate and flexibly attached at the lower end thereof to the support structure 63. The tongue 68 has a first non-locking position or configuration that is seen in FIGS. 7 and 8, wherein the tongue 68 extends forwardly or at an angle to the vertical, as seen in FIG. 7, and a second locking position or configuration that is seen in FIGS. 4 to 6, where the tongue 68 extends upwardly or vertically, as viewed in FIG. 4.

The illustrated tongue 68 is sized to snugly and preferably frictionally fit between the support structure sides 63, when the tongue 68 is in the locking position so that the sides 63 restively hold the tongue 68 in the locking position. The illustrated tongue 68 also includes three panels 70, 71 and 72 (FIG. 4) of approximately equal length that overlap slightly relative to one another so as to form the overall tongue 68 and, in particular, to produce a first shoulder 75 that is spaced from the location where the tongue 68 is hinged to the support structure 68. The juncture of the panels 70, 71 and 72 also forms a recess 77 with the shoulder 75 forming one side thereof. Mounted on the most upper or distal panel 72 of the tongue 68, is a second shoulder forming structure 80, such as a bead, hook, pawl, flange or the like. The structure 80 has a second shoulder 81 formed on the lower side thereof that is generally parallel to the first shoulder 75 and to the location whereat the tongue 68 hinges to the support structure 63, but is spaced from both. The shoulders 75 and 81 are located on the same side of the tongue 68. An upper end 83 of the tongue outer panel 71 is engagable by the finger of a user, so that the user may push of twist the tongue 68 and thereby bend or otherwise deform the tongue 68.

The latch mechanism second portion 61 includes a bar 85 that is supported in spaced relationship from the dispenser lid 7 by a pair of supports 90 and 91 at opposite ends thereof. The bar 85 is sized, shaped and positioned to snugly fit in the recess 77 with a low profile compared to the panels 70 and 72 on either side thereof, as is shown in FIG. 4, when the lid 7 is closed and the tongue 86 is in the locking position thereof. In such a configuration the bar 85 has an upper surface 93 that engages the shoulder 75 and thus locks, holds or secures the bar 85 in the recess 77.

Figure 4:
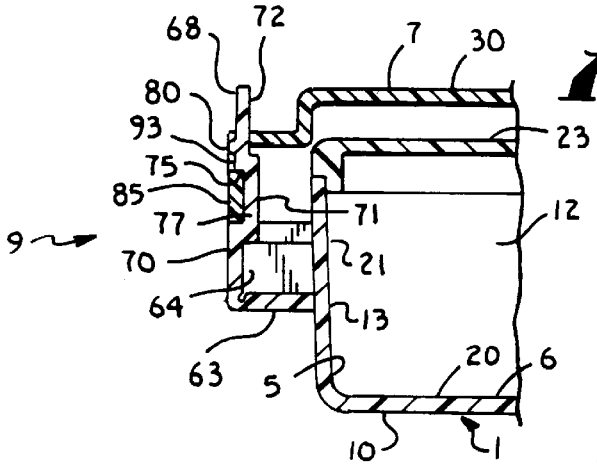
FIG. 4 is an enlarged and fragmentary cross sectional view of the dispenser, taken along line 4—4 of FIG. 1, with the lid in a closed configuration and the latch in the child resistant configuration thereof.

When the bar 85 is held in the tongue recess 77, as seen in FIG. 4, and it is desired to open the dispenser lid 7, the user grasps a pair of ears 94 on opposite sides of the lid 7 and the body of the tray 5 with fingers of opposite hands, then while pulling the lid 7 up and tray 5 down, the user pushes inwardly or toward the tray 5 against the upper panel 72 of the tongue 68. The tongue 68 is thereby bent over the walls 64 so that the upper portion of the tongue 68 flexes so that the shoulder 75 is no longer located in the path of the bar 85 and this releases the bar 85 from the recess 77. The bar 85 is seen released from the recess 77 in FIG. 5 at which time the upper surface 93 of the bar 85 then engages and becomes captured by the shoulder 81 of the structure 80. The user must then again depress the upper panel 72 of the tongue 68 so as to flex the tongue 68 over the walls 64 and free the surface 93 from the shoulder 81, and in this manner allow the lid 7 to be fully opened. This double shoulder (75 and 81) construction requires multiple operations to be performed which make the device more difficult to open for a child and, therefore, more child tamper resistant.

If no children are in the house or other facility where the device is to be used and it is difficult for the user to open a child resistant closure, the tongue 7 can be placed in the non-locking position seen in FIGS. 7 and 8, so that the lid 7 closes and is held in place by frictional engagement with the tray 5, but is relatively easy to open.

It is foreseen that the double shoulder latching concept of the illustrated embodiment can also be used in conjunction with closures of other types than the particular closure device illustrated.

It is to be understood that while certain forms of the present invention have been illustrated and described herein, it is not to be limited to the specific forms or arrangement of parts described and shown.

What is claimed and desired to be secured by Letters Patent is as follows:

1. A closure comprising:

a) a body having at least one compartment therein;

b) a closure lid for the body; said lid blocking access to the compartment when in a closed configuration thereof k and having an open configuration;

c) a hinge mechanism joining the lid to the body; and d) a latch mechanism opposite said hinge mechanism and operably adapted to secure said lid in the closed position thereof when said lid is placed in the closed position; said latch mechanisms including:

i) an elongate tongue attached near one end thereof to a first of said lid and said body; said tongue having first and second shoulders therealong that are spaced from each other and from the location whereat said tongue attaches to the first of said lid and body;

ii) a capture bar secured to a second of said lid and body; said bar being sized and shaped to be engaged and held by said first shoulder when said lid is in the closed configuration thereof; said tongue being sufficiently flexible by application of pressure by a user to disengage said bar from said first shoulder thereby allowing said lid to partially open whereat the bar engages and is held by said second shoulder; said tongue requiring the re-application of pressure thereto by a user to flex said tongue and release the bar from said second shoulder so as to allow said lid to fully open.

2. The closure according to claim 1 wherein:

a) said tongue is flexibly and pivotally joined at one end to the first of the lid and body and has a first locking configuration wherein said tongue engages and secures said lid in the closed configuration of said lid and a non-locking configuration wherein the tongue does not engage the lid in the closed configuration of the lid.

3. The closure according to claim 1 wherein:

a) said tongue has a recess located on the tongue adjacent and partially forming said first shoulder; said recess being sized and shaped to receive said bar.

4. The closure according to claim 3 wherein:

a) said bar is shaped to be fully received in said recess so as to provide a low profile relative to said tongue.

5. The closure according to claim 3 wherein:

a) said bar including a pair of struts on opposite sides thereof to mount said bar on the second of said lid and body.

6. The closure according to claim 1 wherein said tongue is attached to said body, said capture bar is attached to said lid, and:

a) said latch mechanism includes a wall that is sized, shaped and positioned to locate said tongue, when positioned against said wall, to receive said lid in the closed position and over which said tongue must be bent each occurrence in order to allow said tongue to disengage from said lid at both said first and second shoulders so as to allow said lid to fully open.

* * * * *